US006622448B1

(12) United States Patent
Sonne

(10) Patent No.: US 6,622,448 B1
(45) Date of Patent: Sep. 23, 2003

(54) BATT INSULATION HOLD-DOWN CLIPS

(75) Inventor: Jeffrey K. Sonne, Melbourne, FL (US)

(73) Assignee: University of Central Florida, Orlando, FL (US)

( * ) Notice: Subject to any disclaimer, the term of this patent is extended or adjusted under 35 U.S.C. 154(b) by 0 days.

(21) Appl. No.: 09/976,185

(22) Filed: Oct. 12, 2001

(51) Int. Cl.[7] ..... E04C 2/38

(52) U.S. Cl. ..... 52/656.1; 52/407.3; 52/407.4; 52/407.1; 52/712; 52/489.1; 52/489.2

(58) Field of Search ..... 52/407.3, 407.4, 52/376, 714, 404.2, 407.1, 712, 489.1, 489.2

(56) References Cited

U.S. PATENT DOCUMENTS

| | | | | | |
|---|---|---|---|---|---|
| 1,937,843 | A | | 12/1933 | Randall | 189/85 |
| 2,374,623 | A | * | 4/1945 | Sale | 52/712 |
| 3,694,981 | A | | 10/1972 | Cremer et al. | 52/235 |
| 4,318,260 | A | | 3/1982 | Siegel et al. | 52/407 |
| 4,333,290 | A | | 6/1982 | Koberstein | 52/376 |
| 4,590,727 | A | | 5/1986 | Ghahremani et al. | 52/406 |
| 5,117,598 | A | | 6/1992 | Livingston et al. | 52/222 |
| 5,214,892 | A | | 6/1993 | Livingston et al. | 52/222 |
| 6,415,575 | B1 | * | 7/2002 | Thompson | 52/712 |

OTHER PUBLICATIONS

ASM Handbook Committee, *Metals Handbook*, 1977 p. 125, 8$^{th}$ Edition.

* cited by examiner

*Primary Examiner*—Carl D. Friedman
*Assistant Examiner*—Steve Varner
(74) *Attorney, Agent, or Firm*—Brian S. Steinberger; Law Offices of Brian S. Steinberger, P.A.

(57) ABSTRACT

Hold-down clips for insulation. The clips have U-shaped bases for wrapping about the exposed edges of framing members such as 2×4s, 2×6s, 2×8s, and 2×10s, and the like, that are used under roofs, ceilings, floors and walls. The clips have side extending arms that abut against the insulation materials and can include protruding portions which further press the insulation material in place. The U-shaped bases can further include inwardly protruding bent tabs, dimples, and spike portions for further locking the clips to the framing members. The clips can be easily installed without the need for tools such as hammers, nail guns, and staple type guns, as well as not need any additional fasteners such as nails, screws, and staples, in order to be installed. An optional through-hole in the base portion can allow for an extra fastener to be used where the through-hole provides direct guidance for placing the optional fastener. The clips can be formed from stamped metal strips, soldered metal pieces, bent wires, injection molded plastic, and the like.

20 Claims, 7 Drawing Sheets

BATT INSULATION HOLD-DOWN CLIPS

This invention relates to roof, floor and wall insulation, and in particular to a clip device for holding down batt type insulation between flaming members in an attic, under a floor and within a wall.

BACKGROUND AND PRIOR ART

Batt type insulation is a well known type of insulation for use for being fit between framing members in an attic, floor or wall. Currently, the inventor is aware of several well known techniques for supporting insulation between attic roof framing members. All of these techniques generally have problems inherent to their being installed, are labor intensive and have limited application.

FIG. 1 shows a prior art method of using wood lathe strips for supporting attic roof insulation. The wood lathe strips must be individually positioned and then fastened to the outer edges of the wood framing members by fasteners, such as nails, screws, and the like. The use of these materials is often time consuming, and labor intensive, as well as the expense of the fasteners themselves, on top of the wood lathe strips. Besides the additional costs of installation time, and such as the cost of the fasteners, additional expenses can be incurred if a nail gun, and the like, are being used.

FIG. 2 shows a prior art method of using spring rods for supporting attic roof insulation. The spring rods are considered easier to use when compared to the wood lathe strips, but the metal spring rods bend up between the framing members, which compresses the insulation in the middle reducing the insulation value, and can eventually tear into the insulation materials. The spring rods also require two hands to install and significant contact with the insulation.

FIG. 3 shows a prior art method of using plastic mesh for supporting attic roof insulation. Installation of the mesh is time consuming as it must be oriented and must also be fastened to the bottom edges of the framing members. In some cases the mesh could compress the insulation which again reduces its insulating value. Additionally, some type of fasteners must also be used to attach the mesh to the framing members.

FIG. 4 shows a prior art method of using twine for supporting attic roof insulation. The twine material is also labor intensive and time consuming to install since it must be fastened to the wood framing members every 12 to 18 inches to be effective, often by using staples, and the like. Thus, many staples must be done to use the twine on the framing members. Besides the additional costs of installation time, and such as the cost of the staple fasteners, additional expenses can be incurred if a staple gun, nail gun, and the like are being used.

FIG. 5 shows a prior art method of using housewrap material for supporting attic roof insulation. Housewrap such as Tyvek, R-Wrap, and the like, can be used here. However, the material is prone to tears, and the like, and also must be fastened to the framing members every 12 inches or so, often with staples. Besides the additional costs of installation time, and such as the cost of the staple fasteners, additional expenses can be incurred if a staple gun, nail gun, and the like are being used.

FIG. 6 shows a prior art method of using plastic type straps for supporting attic roof insulation. These straps can be made of recycled plastic having wider ends for attaching fasteners such as staples through to the attic framing members. However, again besides the additional costs of installation time, and such as the cost of the staple fasteners, additional expenses can be incurred if a staple gun, nail gun, and the like are being used.

Additional problems with using fasteners such as staples, and nails is that it can be difficult to aim the staples and nails to two inch surfaces that exists on the edges of most framing members. The problem is further compounded since it is hard to check that the staples and nails have been properly used in all the appropriate locations.

Several patents have been proposed over the years for use with supporting insulation materials. See for example, U.S. Pat. No. 1,937,843 to Randall; U.S. Pat. No. 3,694,989 to Cremer et al.; U.S. Pat. No. 4,318,260 to Siegel et al.; U.S. Pat. No. 4,333,290 to Koberstein; U.S. Pat. No. 4,590,727 to Ghahremani et al.; U.S. Pat. No. 5,117,598 to Livingston et al.; and U.S. Pat. No. 5,214,892 to Livingston et al. However, it is believed that none of the references easily and effectively can be used for holding batte type insulation between roof framing members.

SUMMARY OF THE INVENTION

A primary objective of the subject invention is to provide a clip for holding down batte type insulation that does not require any staples, screws and nails to be installed.

A secondary objective of the subject invention is to provide a clip for holding down batte type insulation that does not require any tools to be installed.

A third objective of the subject invention is to provide a clip for holding down batte type insulation that can be simply and easily installed.

A fourth objective of the subject invention is to provide a clip for holding down batte type insulation that is easy to be checked that it has been installed.

A first preferred embodiment has a metal type clip formed from a stamped metal strip, and having cut-outs for forming dual leg portions, raised protrusions in the leg portions for locking the clip to framing members, outwardly bent ends on the leg portions for allowing ease to position the leg portions about framing members. Arm portions extending out perpendicular to the leg portions can have plural raised tabs for allowing the arms and the tabs to compress against insulation material that has been placed between framing members, and the like.

A second embodiment uses single raised tab portions on each arm of the clip, and the ends of the legs having inwardly bent portions for further locking the legs to framing members.

A third embodiment has a clip formed from plural pieces of metal strips attached to one another by welding, soldering and the like. The outer ends of the arms can have bent edges so that the arms and bent edges compress against insulation material that has been positioned between framing members. The legs of this clip can include inwardly raised dimples for further locking the clip to the framing members.

A fourth embodiment forms the clip from a single piece of wire that has been bent along several positions on the wire to form a clip having dual parallel legs, and arms extending perpendicular and outward from the legs.

The embodiments can further be formed from injection molded plastic, and the like.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Framing members can include but not be limited to joist members, truss members, and the like, within a roof, a ceiling, the floor, and the walls of a structure, wherever insulation is needed to be installed.

First Embodiment

Figure 1:
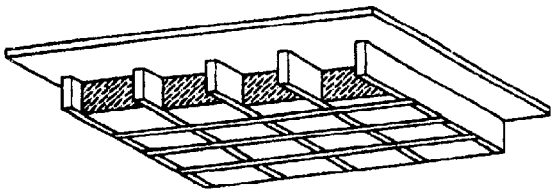
Fig. 1 (Prior Art)
FIG. 1 shows a prior art method of using wood lathe strips for supporting attic roof insulation.
Figure 2:
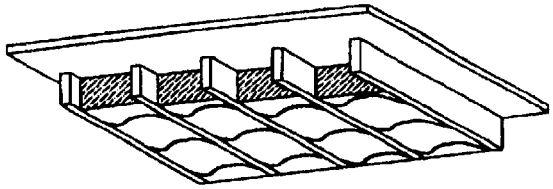
Fig. 2 (Prior Art)
FIG. 2 shows a prior art method of using spring rods for supporting attic roof insulation.
Figure 3:
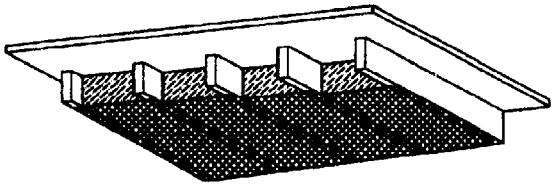
Fig. 3 (Prior Art)
FIG. 3 shows a prior art method of using plastic mesh for supporting attic roof insulation.
Figure 4:
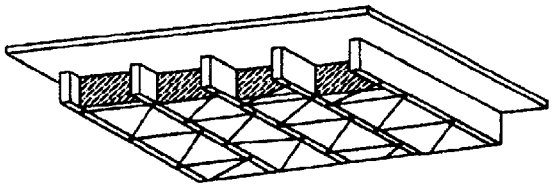
Fig. 4 (Prior Art)
FIG. 4 shows a prior art method of using twine for supporting attic roof insulation.
Figure 5:
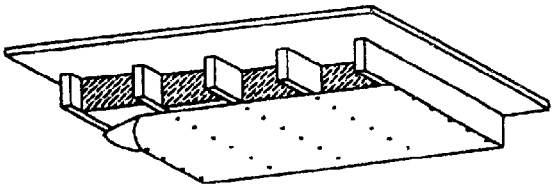
Fig. 5 (Prior Art)
FIG. 5 shows a prior art method of using housewrap material for supporting attic roof insulation.
Figure 6:
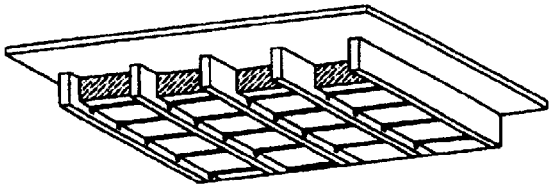
Fig. 6 (Prior Art)
FIG. 6 shows a prior art method of using plastic type straps for supporting attic roof insulation.
Figure 7:
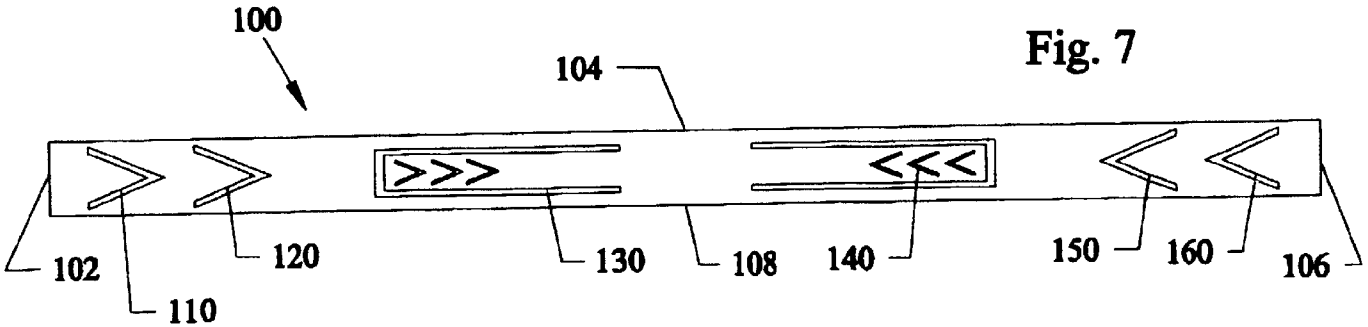
FIG. 7, shows a front view of a metal strip stamped for forming a first embodiment clip.

FIG. 7, shows a front view of a metal strip before stamping for forming a first embodiment clip 100. The metal strip can be formed from metal such as aluminum, galvanized metal, and the like, and have a length of approximately 6 to approximately 16 inches, a width of approximately 0.5 to approximately 1.5 inches, and a thickness of approximately 0.025 inches.

Cut-out stamps in the clip/strip 100 can form tab portions 110, 120, 1 50, 160 that can be of various shapes, such as but not limited to triangular tabs, rounded edge tabs, rectangular edge tabs, spiked end tabs, and the like. Although, two tab portions 110, 120 and 150, 160 are shown on each side of the clip/strip, there can be no tab portion, one tab portion, or more than two tab portions on each side of the strip. Legs 130, 140, each having a length from approximately 1 to approximately 6 inches can be stamp formed about a mid-portion 108 of the clip/strip 100. One each leg stamp portion 130, 140, there can be further tab portions which will described in detail in reference to FIGS. 8A–8B.

Figure 8A:
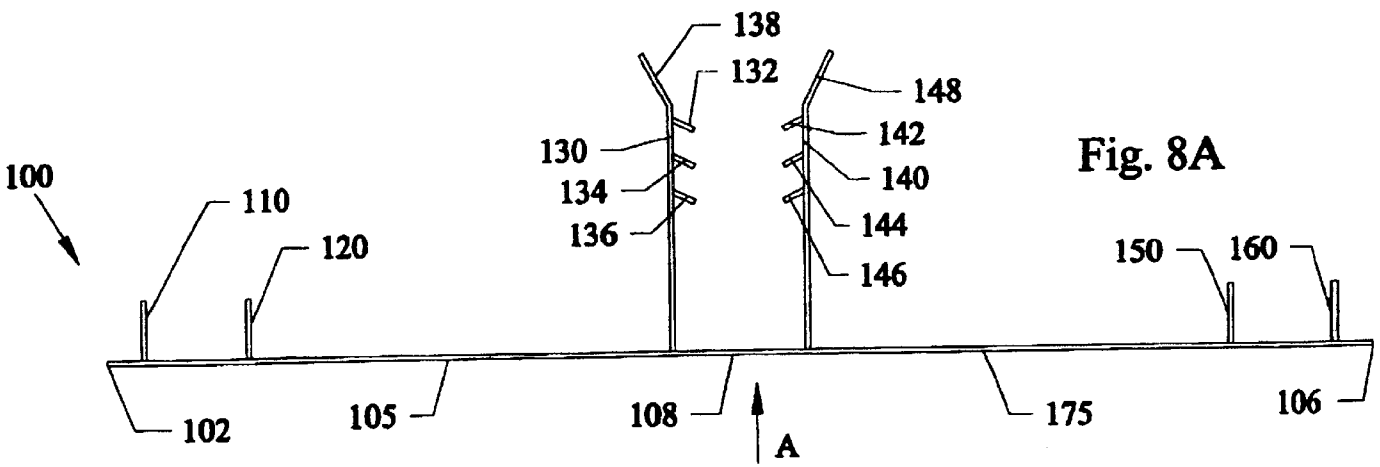
FIG. 8A shows a side view of a novel clip using the stamped strip of FIG. 7.
Figure 8B:
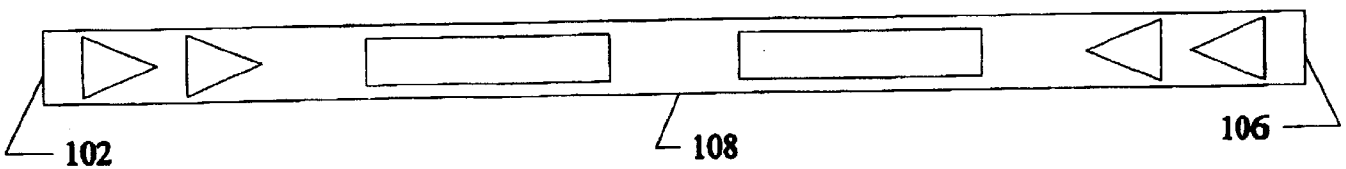
FIG. 8B shows a bottom view of the clip of FIG. 8A along arrow A1.

FIG. 8A shows a side view of a novel clip 100 using the stamped strip of FIG. 7. FIG. 8B shows the same view of the clip 100 of FIG. 8A along arrow Al after stamping. Referring to FIGS. 8A–8B, clip 100 has leg portions 130, 140, bent upward to be substantially parallel to one another, and be substantially perpendicular to clip portions 102, 108, 106. Tab portions 132, 134, 136, 142, 144, 146 in leg portions 130, 140 are bent inward toward one another, with their exposed ends in the direction of clip portion 108. Tab portions 132, 134, 136, 142, 144, 146 can be of various shapes, such as but not limited to triangular tabs, rounded edge tabs, rectangular edge tabs, spiked end tabs, dimples, and the like. Ends 138, 148 of respective leg portions 130, 140 can be bent away from each other. On the side arm portions 105, 175 of clip 100, tab portions 110, 120, and 150, 160 can be bent upward in the direction of legs 130, 140.

Figure 9B:
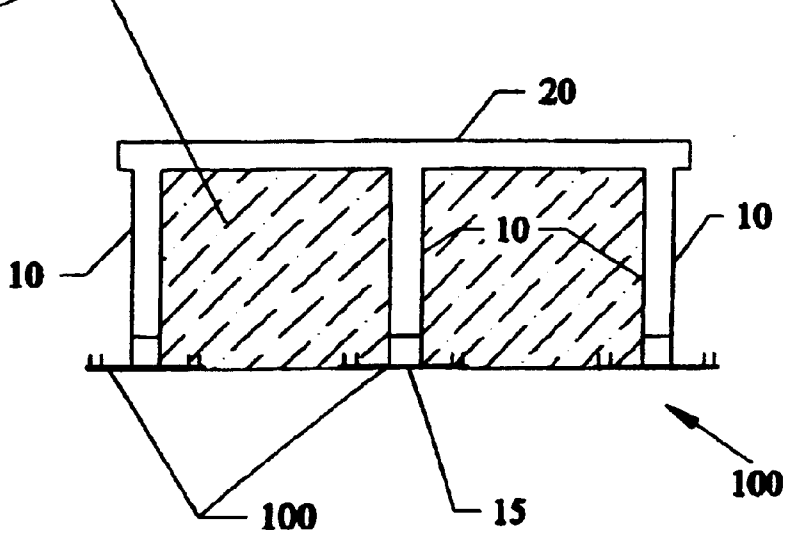
FIG. 9B shows a side view of FIG. 9A along arrow A2.
Figure 9A:
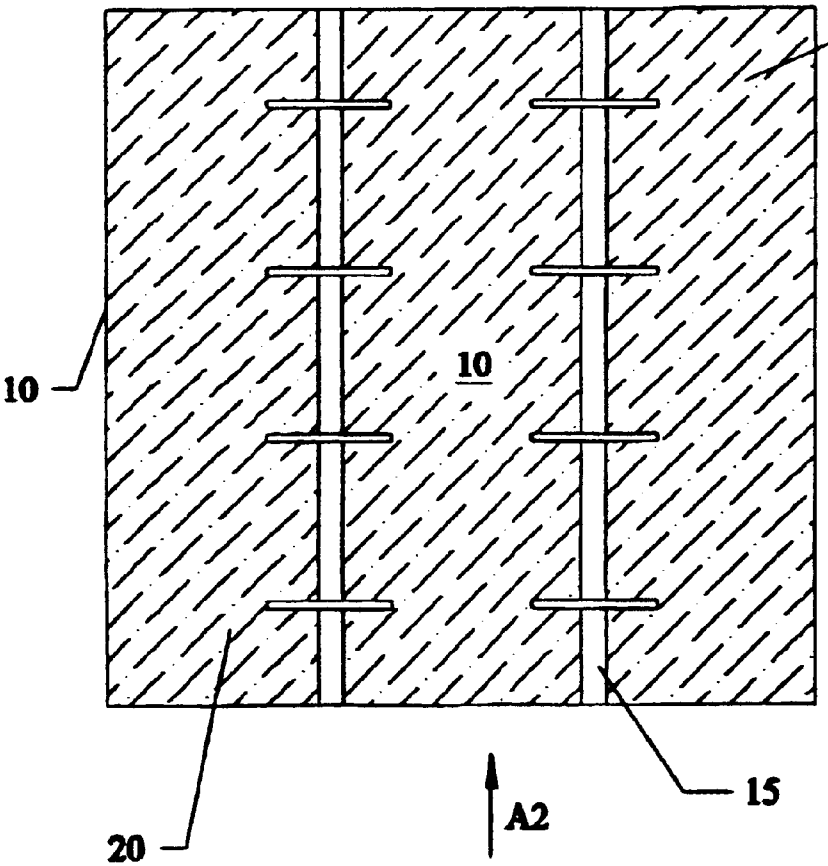
FIG. 9A shows a view of the using the clips of FIGS. 7 and 8A–8B to support insulation between framing members.

FIG. 9A shows a view of using the clip 100 of FIGS. 7 and 8A–8B to support insulation between framing members 10. FIG. 9B shows a side view of FIG. 9A along arrow A2. Referring to FIGS. 8A–8B, 9A–9B, framing members 10, such as joists, trusses, and the like, can be spaced apart from one another for supporting a surface 20, such as a roof deck, floor, drywall, wall, and the like. Insulation material 30, such as but not limited to batt type insulation can be fit between the framing members 10. On the outer edges of the framing members can be optional rigid insulation 15. The expanded out bent portions 138, 148 on leg portions 130, 140 allow the clip 100 to easily slip over the outer edges of the framing members 10. The interior facing tab portions 132, 134, 136 and 142, 144, 146 abut against the sides of the framing members 10 to help lock the clips 100 to the framing members. The raised tab portions 110, 120 and 150, 160 on the arm portions of the clip 100 compress against the insulation material 30.

Second Embodiment

Figure 11B:
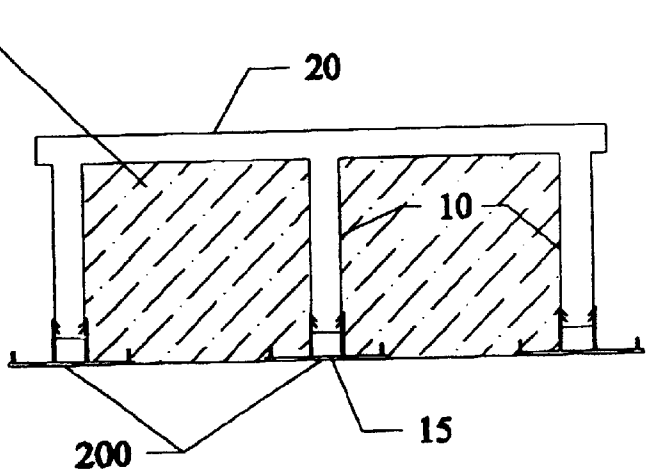
FIG. 11B shows a side view of FIG. 11A along arrow B1.
Figure 10:
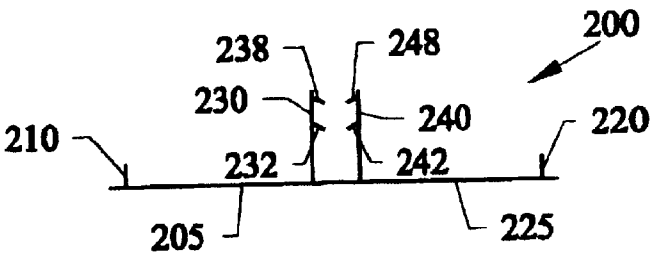
FIG. 10 shows a side view of a second embodiment of the novel clip.
Figure 11A:
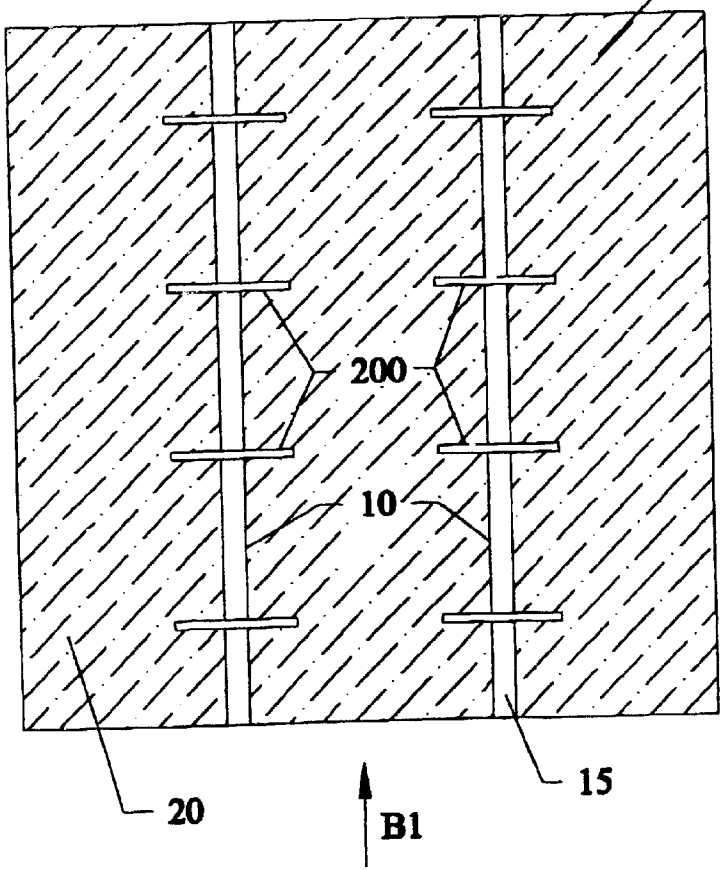
FIG. 11A shows a view of using the clip of FIG. 10 to support insulation material.

FIG. 10 shows a side view of a second embodiment of the novel clip 200. FIG. 11A shows a view of using the clip 200 of FIG. 10 to support insulation material 10. FIG. 11B shows a side view of FIG. 11A along arrow B1. Referring to FIGS. 10 and 11A–11B, clip 200 is similar to clip 100 previously described, and be formed from a stamped metal and can include arm portions 205. 225 each having single tab portions 210, 220 protruding upward therefrom. Leg portions 230, 240 can have single inwardly bending tab portions 232, 242, respectively. The ends of each leg portion 230, 240 can have tips 238, 248 bent inwardly toward one another. These tab portions 232, 242 and bent ends 238, 248 can press into the sides of framing members 10 to better lock the clips 200 to the framing members. Similar to the previous embodiment, arm portions 205, 275 and tab portions 210, 220 compress against insulation materials 30 holding the insulation material 30 in place between framing members 10.

Third Embodiment

Figure 12:
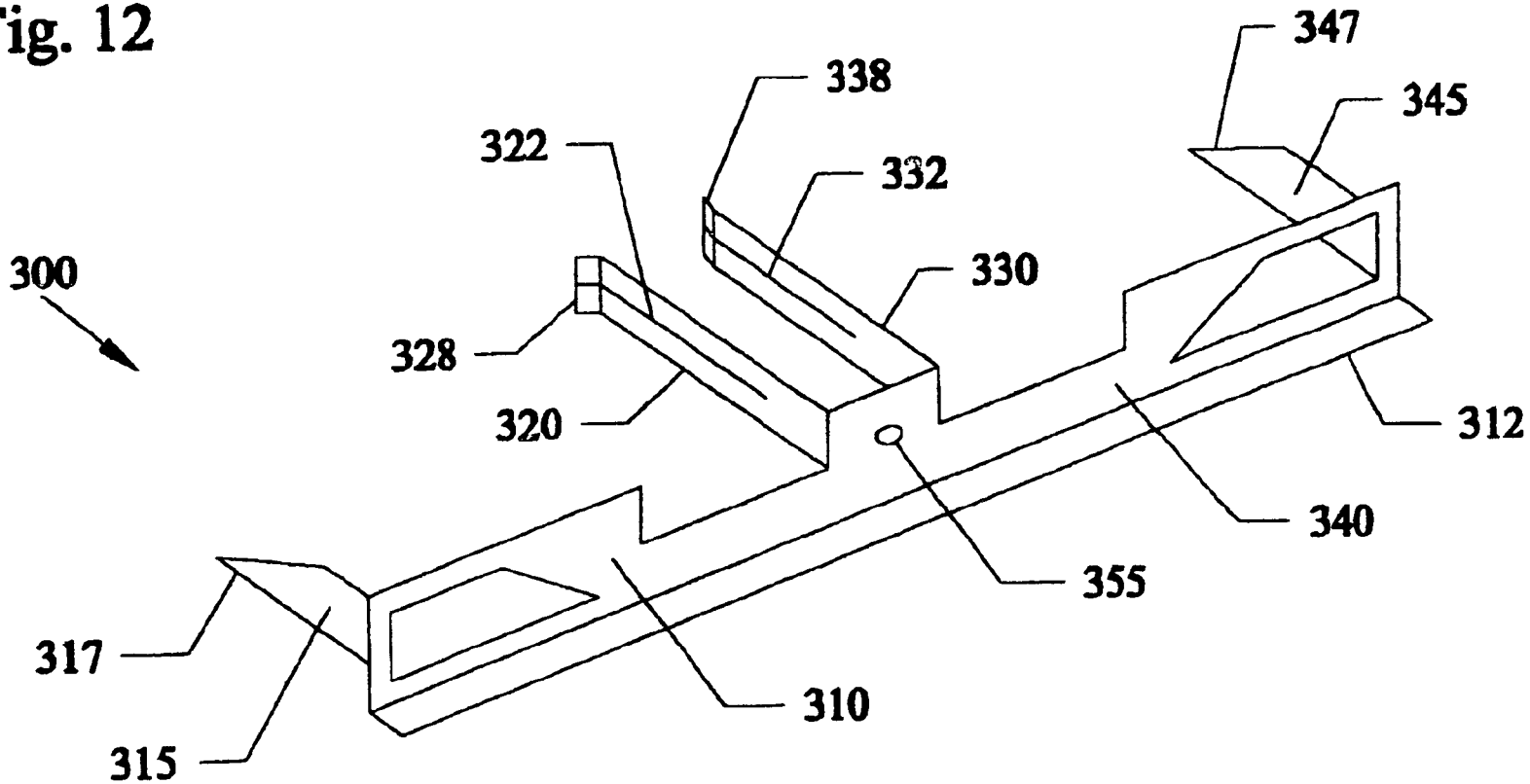
FIG. 12 shows a perspective view of a third embodiment clip.
Figure 13:
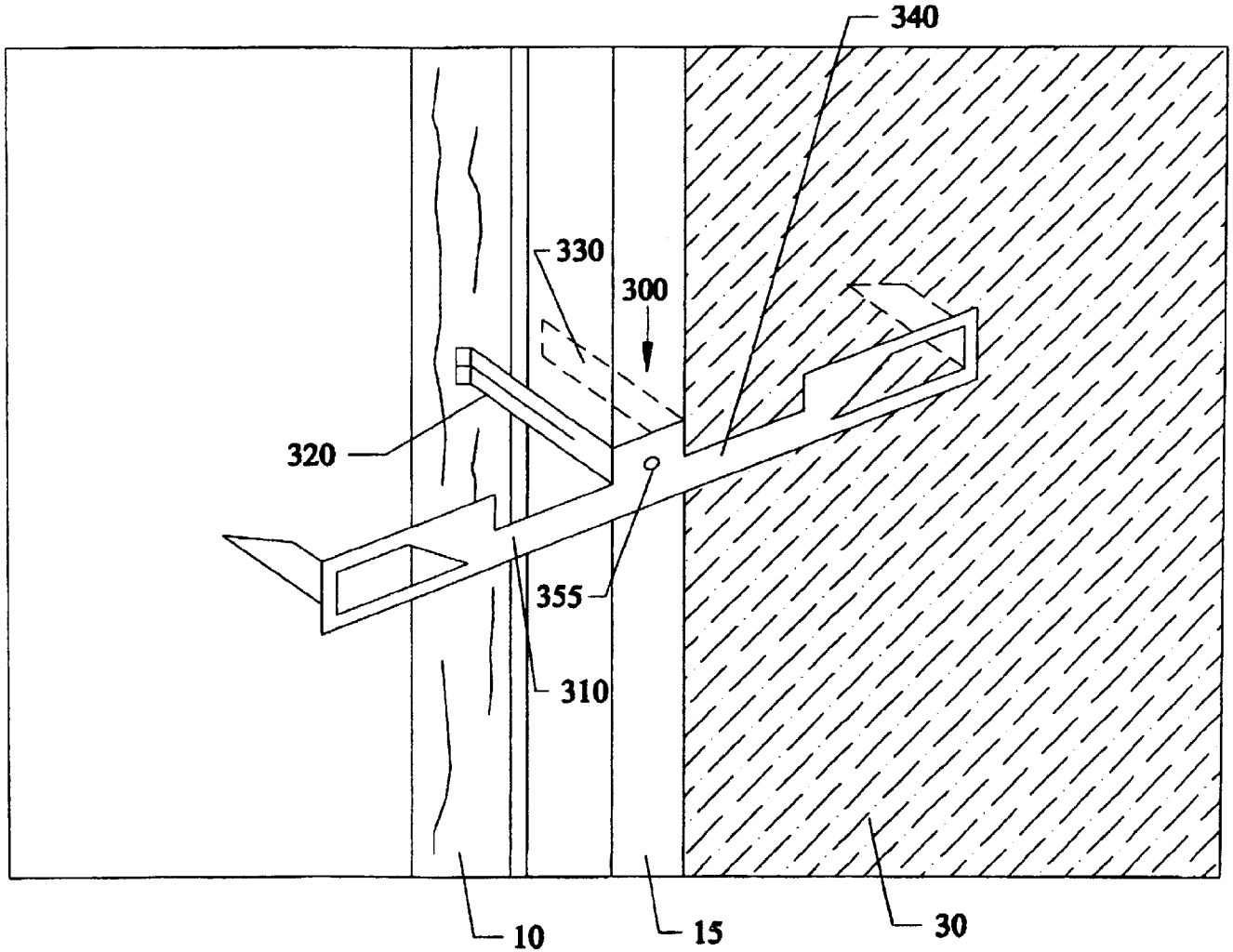
FIG. 13 shows the clip of FIG. 12 used to support insulation material.

FIG. 12 shows a perspective view of a third embodiment clip 300. FIG. 13 shows the clip 300 of FIG. 12 used to support insulation material 30. Referring to FIGS. 12 and 13, clip 300 can be formed from a several pieces of metal type planar strips such as but not limited to aluminum, and galvanized metal, and the like. Clip 300 can include base arm portions 310, 340 each having outer ends 315, 345 bent substantially perpendicular thereto, with narrow tip portions 317, 347.that can press into insulation material 30 when clip legs 320, 330 are wrapped about framing member 10. Each interior side of the leg portions 320, 330 can include inwardly projecting dimpled portions 322, 332 for helping lock the clip 300 to the framing member 10. Outwardly bent ends 328, 338 allow for ease in positioning the leg portions 320, 330 about the framing member 10. An optional through-hole 355 in the base portion of the clip 300 between the leg portions 320, 330 allows for using optional fasteners such as but not limited to screws, nails and the like, to further lock the clip 300 to the framing member 10. Clip 300 can be formed from separate metal type strip materials that are attached to one another by welding, soldering and the like. Furthermore, an optional folded edge 312 can be formed in base portion 310 to aid in strengthening and making the clip 300 more sturdy.

Fourth Embodiment

Figure 14:
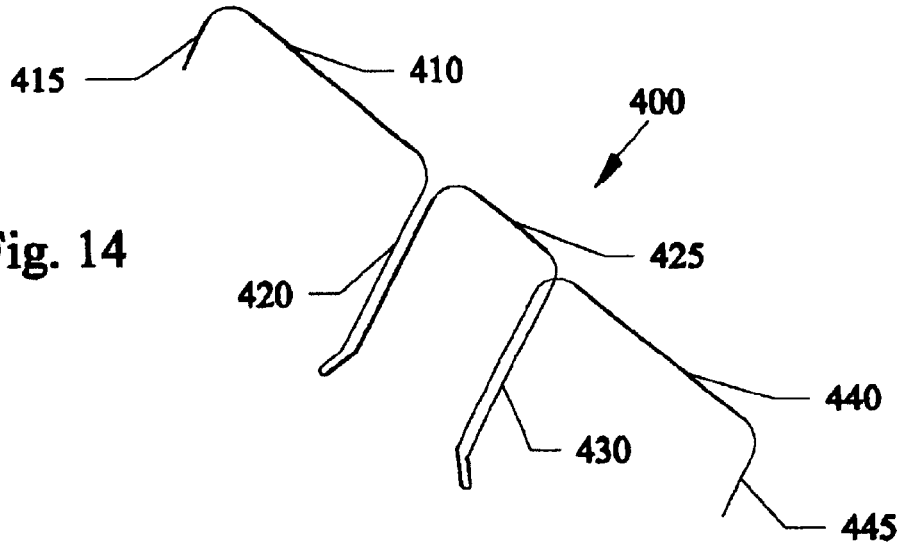
FIG. 14 shows a perspective view of a fourth embodiment clip.
Figure 15:
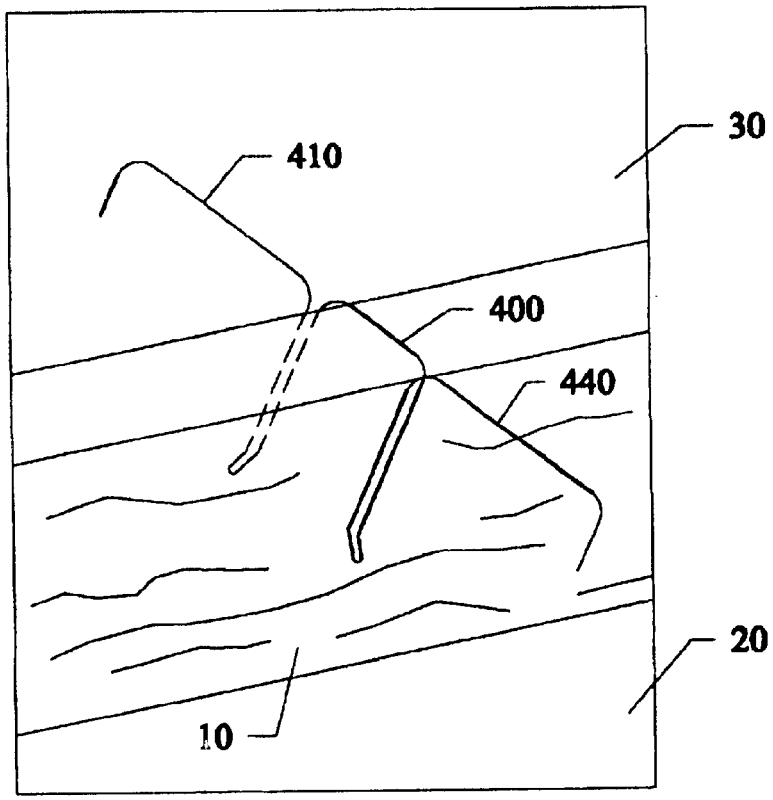
FIG. 15 shows the clip of FIG. 14 used to support insulation material.

FIG. 14 shows a perspective view of a fourth embodiment wire clip 400. FIG. 15 shows the clip 400 of FIG. 14 used to support insulation material 30. Clip 400 can be mounted similar to the clips previously described. Clip 400 includes arm portions 410, 440 having inwardly bent ends 415, 445, respectively, which compress against the insulation material 30 that is located adjacent to framing members 10. Along a midportion of clip 400 can be interior projecting loop bent portions 420, 430 which function as leg portions to wrap clip 400 about framing members 10. The leg portions 420, 430 can include extra inwardly directed bent portions to function similar to the inwardly projecting tabs on the previous embodiments. Clip 400 can be formed from a single wire bent at strategic positions to form the clip 400 shown in FIGS. 14 and 15.

The optional through-hole shown in the third embodiment can also be used in any of the other embodiments, to add further locking of the clips to the framing members. The through-hole can act as a guide for allowing the optional fastener to pass therethrough.

Although the preferred embodiments describe using stamped metal strips, and bent wires, the invention clips can each be formed from injection molded plastic, and the like.

While the third embodiment shows folded edges for strength and reinforcement, all of the embodiments can use this type of strengthen and reinforcement technique. The clips can also have either or both their leg portions and arm portions strengthened and reinforced by different techniques such as but not limited to using different thickness materials, bending side combinations of different materials with the clip, using flanges, folded edges, forming ribs, beads and bosses, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A clip for supporting insulation materials between framing members, comprising:

a base portion having two legs protruding therefrom, the legs being parallel to one another, wherein a side portion of each of the legs includes an inwardly protruding member; and arms extending outward away from the base portion, the arms being substantially perpendicular to the legs.

2. The clip of claim 1, wherein the inwardly protruding member includes: p1 a bent tab.

3. The clip of claim 1, wherein the inwardly protruding member includes:

a dimple.

4. The clip of claim 1, wherein the inwardly protruding member includes:

a spike.

5. The clip of claim 1, wherein a bottom portion of each of the legs includes:

an outwardly bent portion.

6. The clip of claim 1, wherein each of the arms includes:

a downwardly protruding member.

7. The clip of claim 6, wherein the downwardly protruding member is:

a portion of an outer edge of each of the arms.

8. The clip of claim 6, wherein the downwardly protruding member includes:

two protruding members on each arm.

9. The clip of claim 1, further comprising:

a through-hole in the base portion between the legs for mounting a fastener therethrough.

10. The clip of claim 1, wherein the base portion, the legs and the arms are formed from:

injection molded plastic.

11. The clip of claim 1, wherein the base portion, the legs and the arms are formed from:

a stamped metal strip.

12. The clip of claim 1, wherein the base portion, the legs and the arms are formed from:

a bent wire.

13. A clip system for supporting insulation between framing members, comprising in combination:

a first framing member and a second framing member parallel to each other, the first and the second framing members being mounted against a surface, the surface selected from at least one of a roof, a floor, and a wall;

insulation material positioned between the first and the second framing member and abutting against the surface; and a clip having extended arms, the clip mounted on at least one of the first and the second framing member, wherein the clip is installed without tools and fasteners, and at least one of the extended arms has a portion that holds the insulation material against the surface, the clip having a U-shaped base which wraps about an edge of the framing members, the U-shaped base having an inwardly protruding member which abuts against the framing members.

14. The clip system of claim 13, wherein the U-shaped base includes:

outwardly bent lower end portions.

15. The clip system of claim 13, wherein each of the extended arms include:

a downwardly protruding member which abuts against the insulation material.

16. A method of supporting insulation material between framing members of a roof, comprising:

inserting insulation material between the framing members of the roof, attaching a U-shaped base portion of a clip onto at least one exposed edge of at least one of the framing members without using an tools and fasteners; and pressing at least one arm extending from the clip against a portion of the insulation material holding the insulation material between the framing members.

17. The method of claim 16, further comprising the step of:

locking the U-shaped base portion in place by pressing an inwardly protruding portion on the U-shaped base portion against one side of the least one of the framing members.

18. A clip for supporting insulation materials between framing members, comprising:

a base portion having two legs protruding therefrom, the legs being parallel to one another;

arms extending outward away from the base portion, the arms being substantially perpendicular to the legs; and two downwardly protruding members on each arm.

19. A clip for supporting insulation materials between framing members, comprising:

a base portion formed from a wire material having two legs downwardly protruding therefrom, the legs being parallel to one another, the legs each having a loop configuration; and arms formed from the wire material, extending outward away from the base portion, the arms being substantially perpendicular to the legs.

20. A clip system for supporting insulation between framing members, comprising in combination:

a first framing member and a second framing member parallel to each other, the first and the second framing members being mounted against a surface, the surface selected from at least one of a roof, a floor, and a wall;

insulation material positioned between the first and the second framing member and abutting against the surface; and a clip having extended arms, the clip mounted on at least one of the first and the second framing member, wherein the clip is installed without tools and fasteners, and at least one of the extended arms has a portion that holds the insulation material against the surface, the clip having a U-shaped base which wraps about an edge of the framing members, the U-shaped base having outwardly bent lower end portions.

* * * * *